US005706913A

United States Patent [19]

Rivera

[11] Patent Number: 5,706,913

[45] Date of Patent: Jan. 13, 1998

[54] GUIDE ASSEMBLY FOR AN ELEVATOR DOOR

[75] Inventor: James A. Rivera, Bristol, Conn.

[73] Assignee: Otis Elevator Company, Farmington, Conn.

[21] Appl. No.: 550,974

[22] Filed: Oct. 31, 1995

[51] Int. Cl.[6] ..... B66B 13/06

[52] U.S. Cl. ..... 187/334; 47/411

[58] Field of Search ..... 187/333, 334; 49/120, 116, 411

[56] References Cited

U.S. PATENT DOCUMENTS 3,426,480 2/1969 Dzamba ..... 187/333
4,781,270 11/1988 Holland ..... 187/56

FOREIGN PATENT DOCUMENTS 6239574 2/1993 Japan .

*Primary Examiner*—Kenneth Noland

[57] ABSTRACT

A door guide assembly for an elevator cab includes a gib bracket and a sill having a guide groove in the face of the sill. The guide bracket extends down from the door and into the guide groove to guide the motion of the door. The guide groove includes a narrow opening and an expanded section inward of the opening. Engagement between the narrow opening and the gib bracket prevents excessive vertical movement of the door and engagement between the expanded section and the gib bracket prevents excessive lateral motion of the door.

5 Claims, 3 Drawing Sheets

GUIDE ASSEMBLY FOR AN ELEVATOR DOOR

TECHNICAL FIELD

The present invention relates to elevators doors, and more particularly to guide assemblies for such doors.

BACKGROUND OF THE INVENTION

A typical elevator door is hung from a set of rollers that roll in a track attached to the elevator car. A door opening mechanism extends from the top of the car and engages the door to move it between an open and a closed position. A gib and guide groove is used to control the motion of the bottom of the door. The guide groove is disposed in the upper surface of the sill under the door and the gib extends downwardly from the bottom of the door and into the groove. Excessive lateral motion of the door is prevented by interference between the gib and the guide groove.

This type of guidance for the elevator door, however, is a source of significant maintenance. Since the guide groove is in the upper surface of the sill and is therefore exposed to the path of passengers entering and exiting the elevator, it is susceptible to the accumulation of dirt and debris. This accumulation of foreign objects in the guide groove increases the drag on the door and may cause the door to stall. If the foreign object is large enough, or the accumulation is significant enough, the gib and door may jam and make the elevator inoperable until the guide groove is cleaned.

A solution suggested in Japanese Patent Application 6-239574 is to place the guide groove on the underside of the sill. The gib extends down from the bottom of the door, around the sill and up into the groove. In this way the guide groove is not exposed to the passenger entering and exiting the elevator. In addition, since the guide groove faces downward, loose debris will fail out of the guide groove and not accumulate.

The above art notwithstanding, scientists and engineers under the direction of Applicant's Assignee are working to develop effective elevator door guide assemblies requiring minimal maintenance.

DISCLOSURE OF THE INVENTION

According to the present invention, a door guide assembly includes a sill having a guide groove in the face of the sill. The guide bracket extends down from the door and into this guide groove to guide the movement of the door. Having the guide groove in the face of the sill, rather than the top surface, avoids the accumulation of debris in the guide groove. As a result, the door guide assembly improves the performance of the door guide assembly and minimizes the amount of maintenance required for the door system.

In addition, having the guide groove in the face rather than the bottom surface of the sill permits the sill to be attached to the elevator by engagement with the bottom of the sill. As a result, the sill does not have to be cantilevered off the elevator and the retention of the sill to the elevator does not have to compensate for the large stresses associated with a cantilevered sill. Also, having the guide groove in the face permits the portion of the face below the guide groove to remain available for mounting of a toe guard flush with the front of the cab. If the guide groove is in the bottom of the sill, the gib bracket extends over the face and would preclude mounting the toe guard on the face of the sill.

A further advantage of the present invention is that the guide groove provides the additional safety feature of supporting the door in the event that the door becomes dislodged from its upper tracks. This safety feature minimizes the possibility of the door falling from the car and through the hoistway. In addition, the guide groove supports the door during required fire testing of elevator cab door entrances.

According to a particular embodiment of the present invention, the guide groove includes a narrow opening and an expanded section inward of the opening. The narrow opening is sized to permit insertion and motion of the gib bracket while the expanded section is adapted to receive a guide disposed on the distal end of the bracket. Interference between the gib bracket and the narrow opening prevents excessive vertical movement of the door. Interference between the guide and the expanded section guides the motion of the door and prevents excessive motion lateral to the desired direction of motion of the door. The interaction between the narrow opening and expanded section of the guide groove and the gib bracket stabilizes the door by preventing excessive motion in a direction other than the desired direction.

The foregoing and other objects, features and advantages of the present invention become more apparent in light of the following detailed description of the exemplary embodiments thereof, as illustrated in the accompanying drawings.

BEST MODE FOR CARRYING OUT THE INVENTION

Figure 1:
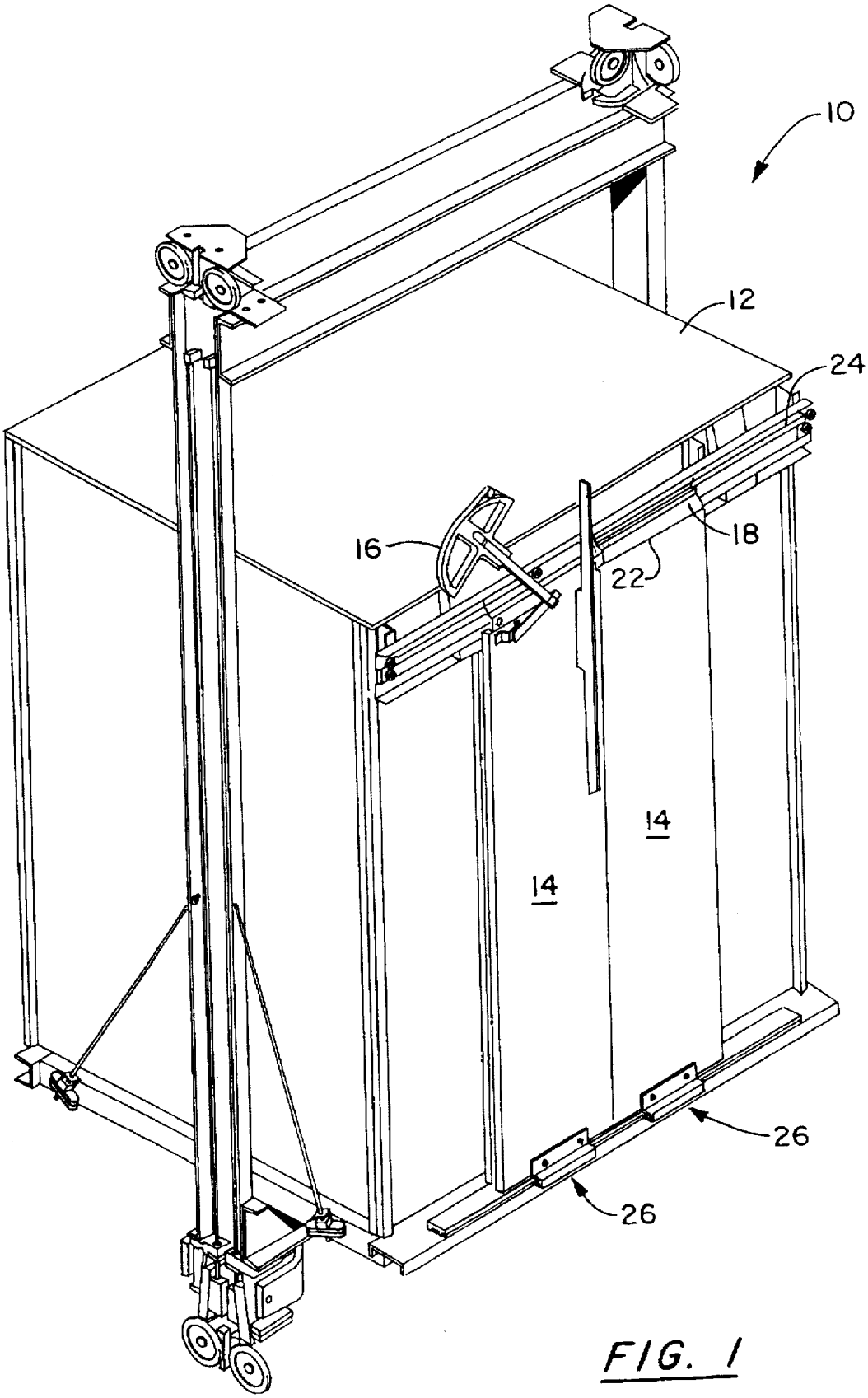
FIG. 1 is a perspective view of an elevator.
Figure 2:
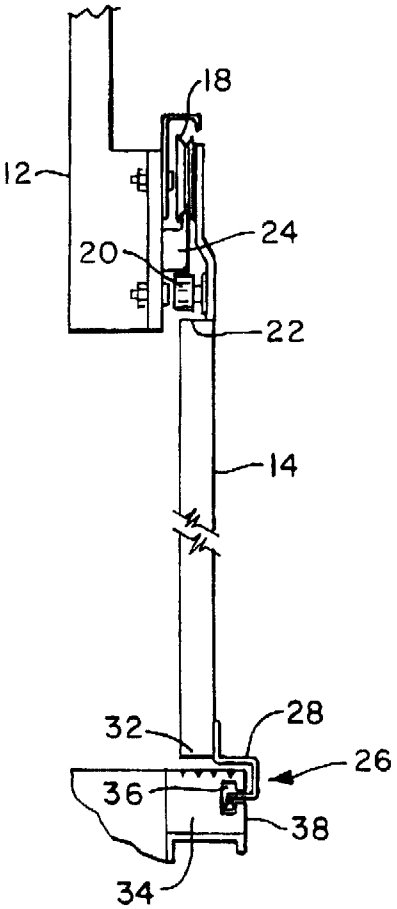
FIG. 2 is a side view of a door system for the elevator.

Illustrated in FIGS. 1 and 2 is an elevator 10. The elevator includes a cab 12 having a pair of doors 14 and a door operating mechanism 16. The pair of doors 14 are hung from a plurality of rollers 18 attached to the top edge 22 of the doors 14 and engaged with a track 24 attached to the cab 12. Immediately below the rollers 18 are upthrust rollers 20 that are proximate to the underside of the track 24 to block excessive upward motion of the door 14 which may cause the rollers 18 to become disengaged from the track 24. Operation of the door operating mechanism 16 causes the rollers 18 to roll within the track 24 and thereby guide the motion of the doors 14.

Figure 3:
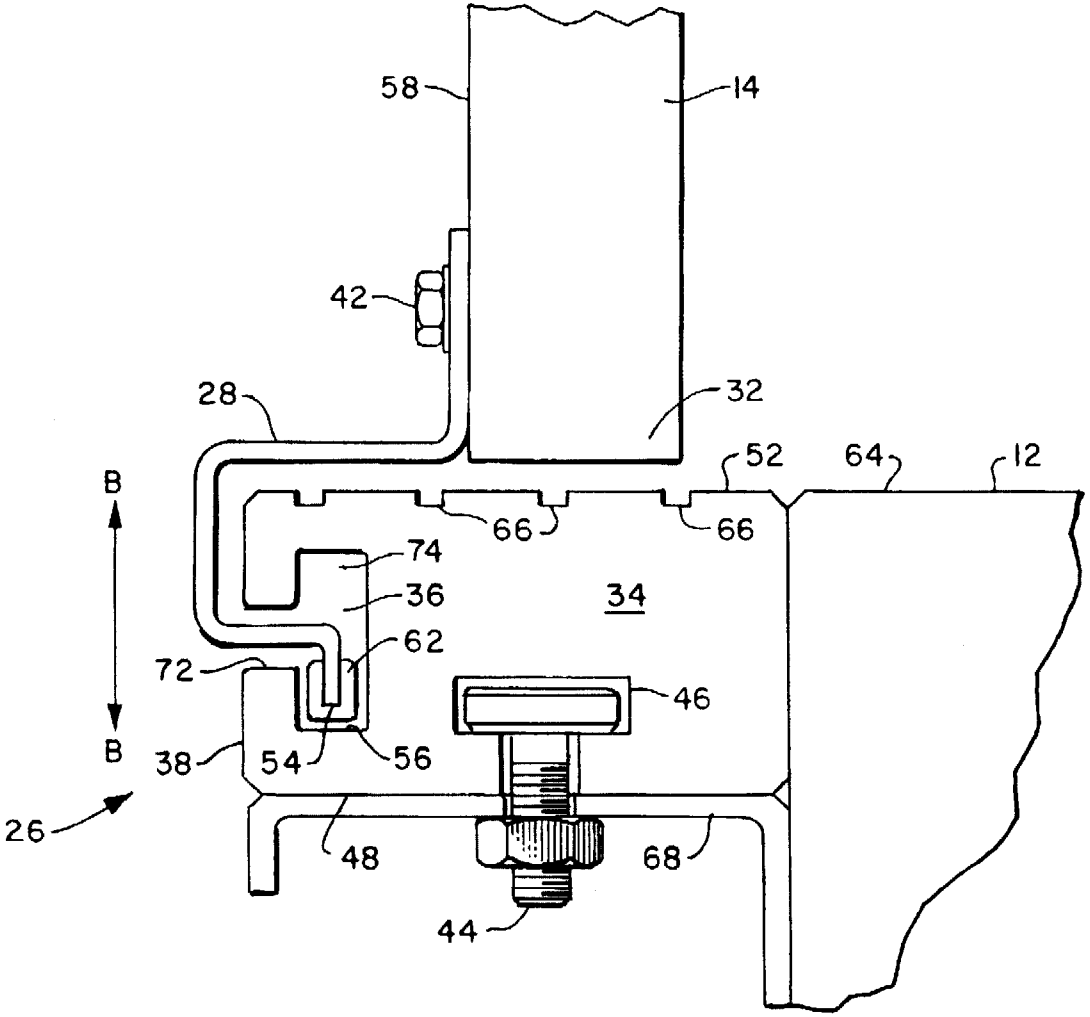
FIG. 3 is a side view of the door showing a gib bracket and sill.
Figure 4:
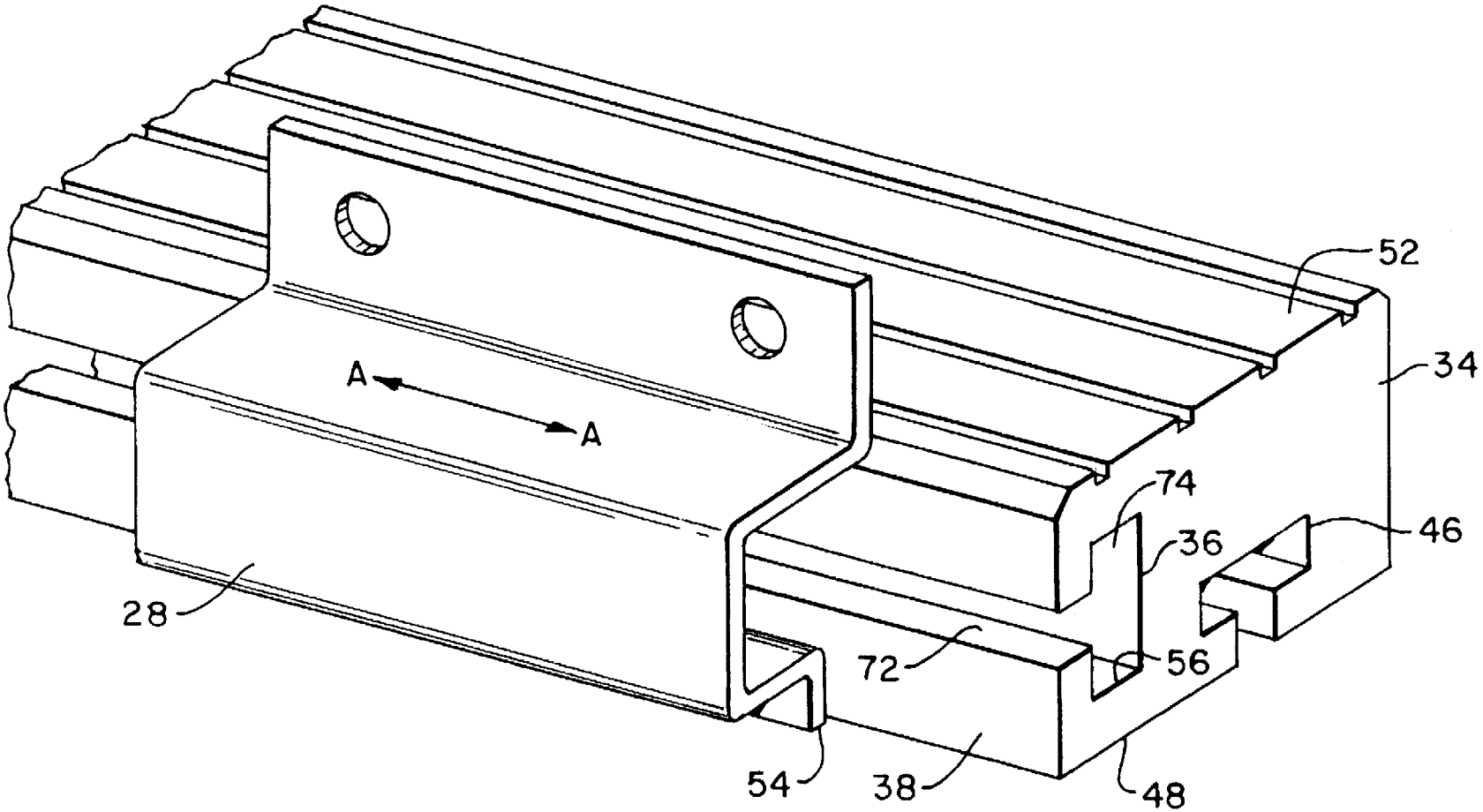
FIG. 4 is a perspective view of the gib bracket and sill.

Means 26 to guide the motion of the bottom of the doors is illustrated in FIGS. 3 and 4. The guide means 26 includes a gib bracket 28 attached to the bottom edge 32 of the door 14 (only one of which is shown in FIG. 3) and a sill 34 having a guide 36 groove in the front surface 38 of the sill 34. The gib bracket 28 is attached to the door 14 by a fastener 42. The sill 34 is attached to the cab 12 by a tie down bolt 44 engaged with a retention slot 46 in the bottom surface 48 of the sill 34.

The gib bracket 28 extends outward from the door 14 and over the top surface 52 of the sill 34. Outward of the sill 34, the gib bracket 28 bends down over the front surface 38 of the sill 34 and then inward and into the guide groove 36. Within the guide groove 36, the gib bracket 28 bends downward such that the distal end 54 of the gib bracket 28 is oriented towards the bottom 56 of the guide groove 36. As shown in FIG. 4, the gib bracket 28 extends longitudinally (see arrow A—A) only a short distance along the bottom edge 32 of the door 14. The longitudinal length of the gib bracket 28 is approximately half the width of the door 14 and is centered, widthwise, along the bottom of the door 14. The required longitudinal length of the gib bracket 28 will balance the benefit of the additional stability a longer bracket will provide with the additional accuracy required in the alignment of the gib bracket 28, guide groove 36, rollers 18 and track 24. Although shown in FIGS. 3 and 4 as extending over the top surface 52 of the sill 34, it should be apparent to those skilled in the art that if the front surface 58 of the door 14 were flush with the front surface 38 of the sill 34, the gib bracket 28 would extend downward from the door 14 and then bend into the guide groove 36. It is the engagement of the gib bracket 28 with the guide groove 36 in the front surface 38 of the sill 34 that guides the motion of the door 14.

A guide 62 is disposed upon the distal end 54 of the gib bracket 28. The guide 62 is formed from a low friction material, such as an ultra-high molecular weight polyethylene (UHMW) and is in close proximity to the surfaces of the guide groove 36. The guide 62 defines the primary contact surfaces for sliding engagement between the gib bracket 28 and the sill 34.

The sill 34 includes the top surface 52 that faces toward the door 14 and is flush with the floor 64 of the elevator cab 12. The top surface 52 defines a portion of the passage for passengers entering and exiting the elevator cab 12. The top surface 52 has a plurality of surface grooves 66 to enhance traction for the passengers stepping on the sill 34.

The bottom surface 48 of the sill 34 rests upon a portion of the elevator platform 68 and is fixed to the platform 68 by the engagement between the tie down bolt 44, the retaining slot 46 and the platform 68. Using the bottom surface 48 of the sill 34 to retain the sill 34 to the platform 68 avoids having the sill 34 cantilevered off the front end of the elevator cab 12 and avoids the stress concentrations associated with such a cantilevered support arrangement.

The front surface 38 extends between the top surface 52 and the bottom surface 48 and includes the guide groove 36. The guide groove 36 extends longitudinally along the sill 34 as shown in FIG. 4. The guide groove 36 includes a narrow opening 72 and an expanded section 74 inward of the opening 72. The narrow opening 72 is wide enough to permit insertion of the gib bracket 28 with the surfaces of the gib bracket 28 in close proximity. The expanded section 74 extends both above and below the narrow opening 72. The lower portion of the expanded section 74 is sized to accommodate the shape of the distal end 54 of the gib bracket 28 and the guide 62 disposed on the distal end 54. The upper portion of the expanded section 74 is symmetrical to the lower portion to facilitate manufacturing of the guide groove 36 and to provide space for maneuvering of the gib bracket during installation and removal of the door 14.

During operation, the door operating mechanism 16 provides opening and closing force on the doors 14. In response to the forces, the doors 14 open and close, guided at the top edge 22 by the engagement of the rollers 18 in the track 24. The engagement of the gib bracket 28 and the guide groove 36 prevents excessive motion of the door 14 other than in the desired direction, i.e. longitudinally. More specifically, interference between the guide 62 and the surfaces of the expanded section 74 will prevent excessive lateral movement (see arrow A—A) of the door 14, such as by pivoting about the longitudinal axis of the tracks 24. Excessive lateral movement of the door 14 may cause the doors to jam during operation. In addition, interference between the gib bracket 28 and the surfaces of the narrow opening 72 will prevent excessive vertical movement (see arrow B—B) of the doors 14. Excessive vertical movement may cause the doors 14 to become disengaged from the tracks 24. In the unlikely event that one of the doors 14 becomes disengaged from the tracks 24, the arrangement between the gib bracket 28 and the guide groove 36 provides means to support the door 14 such that it does not fall through the hoistway.

Installation of the door 14 is accomplished by tilting the top of the door 14 away from the cab 12 and inserting the gib bracket 28 into the guide groove 36. Once inserted, the door 14 is rotated into an upright position and lifted to engage the rollers 18 with the track 24. After engaging the rollers 18 and the track 24, the upthrust rollers 20 are installed. Removal of the door 14 is a similar procedure except in the reverse order. First, the upthrust rollers 20 are removed. Next the door 14 is lifted to disengage the rollers 18 from the track 24. Then, the door 14 is tilted away from the cab 12 and the gib bracket 28 is removed from the guide groove 36. Although the invention has been shown and described with respect to exemplary embodiments thereof, it should be understood by those skilled in the art that various changes, omissions, and additions may be made thereto, without departing from the spirit and scope of the invention.

What is claimed is:

1. A door assembly for an elevator including:

a door including a gib bracket disposed in a fixed relationship to the door, the gib bracket including a guide disposed on the distal end of the gib bracket; and a sill extending longitudinally and adjacent to the path of the door, the sill including an upper surface facing the door, a lower surface facing oppositely of the upper surface, and a front surface extending between the upper surface and the lower surface, the front surface including a guide groove extending longitudinally, wherein the guide groove includes an opening and expanded section inward of the opening, the opening sized to permit insertion of the guide and guide bracket, the expanded section including a lower portion extending below the opening and sized to accommodate the shape of guide;

wherein the gib bracket extends through the opening such that the guide is disposed in the lower portion of the expanded section to guide the movement of the door.

2. The door assembly according to claim 1, wherein the lower surface of the sill includes means to retain the sill to the elevator.

3. The door assembly according to claim 1, wherein the guide and guide groove have complementary shapes to permit movement of the guide through the guide groove in the direction of door movement.

4. A method of installing a door to an elevator, the door including a gib bracket disposed in a fixed relationship to the door, the gib bracket including a guide disposed on the distal end of the gib bracket, the elevator including a sill having a from surface including a guide groove extending longitudinally along the sill, wherein the guide groove includes an opening and expanded section inward of the opening, the opening sized to permit insertion of the guide and guide bracket, the expanded section including a lower portion extending below the opening and sized to accommodate the shape of guide; the method including the steps of:

tilting the door away from its installed position;

inserting the guide through the opening and into the expanded section; and rotating the door such that the guide is disposed in the lower portion of the expanded section.

5. The method according to claim 4, wherein the elevator system further includes a track, and wherein the door further includes a roller adapted to be engaged with the track to support the door in the installed position, and further including the step of lifting the door to engage the roller with the track after the step of rotating the door such that the guide is disposed in the lower portion of the expanded section.

* * * * *